US008362895B2

(12) United States Patent
Teta et al.

(10) Patent No.: US 8,362,895 B2
(45) Date of Patent: Jan. 29, 2013

(54) SYSTEMS AND METHODS OF INFORMATION DISTRIBUTION

(75) Inventors: Robert Teta, Louisville, KY (US); Phong T. Nguyen, Garland, TX (US); W. Allen Fritts, Northford, CT (US)

(73) Assignee: Honeywell International Inc., Morristown, NJ (US)

( * ) Notice: Subject to any disclaimer, the term of this patent is extended or adjusted under 35 U.S.C. 154(b) by 768 days.

(21) Appl. No.: 11/677,865

(22) Filed: Feb. 22, 2007

(65) Prior Publication Data

US 2008/0204222 A1 Aug. 28, 2008

(51) Int. Cl.
*G08B 29/00* (2006.01)

(52) U.S. Cl. ..... 340/531; 340/506; 340/628; 725/105

(58) Field of Classification Search ..... 340/628, 340/531, 506; 725/105
See application file for complete search history.

(56) References Cited

U.S. PATENT DOCUMENTS 3,882,465 A * 5/1975 Cook et al. ..... 340/3.51
5,065,343 A * 11/1991 Inoue ..... 345/558
7,015,806 B2 * 3/2006 Naidoo et al. ..... 340/531
7,114,169 B1 * 9/2006 Kahn ..... 725/33
7,492,253 B2 * 2/2009 Ollis et al. ..... 340/540
2003/0050536 A1 3/2003 Hood et al.
2003/0062997 A1 * 4/2003 Naidoo et al. ..... 340/531
2005/0148828 A1 7/2005 Lindsay
2005/0273831 A1 * 12/2005 Slomovich et al. ..... 725/105
2006/0005219 A1 * 1/2006 Owens ..... 725/33
2006/0139466 A1 6/2006 Johansen
2006/0210167 A1 * 9/2006 Inoue et al. ..... 382/190
2007/0225637 A1 * 9/2007 Ono et al. ..... 604/65
2007/0226762 A1 * 9/2007 Girgis et al. ..... 725/33
2007/0256105 A1 * 11/2007 Tabe ..... 725/78
2008/0129822 A1 * 6/2008 Clapp et al. ..... 348/143
2010/0277317 A1 * 11/2010 Putterman et al. ..... 340/540

OTHER PUBLICATIONS

International Search Report, mailed Jul. 1, 2008 corresponding to International application No. PCT/US08/53787.
International Preliminary Report for PCT/US2006/03547851487, dated Mar. 18, 2008 (6 pages).

* cited by examiner

*Primary Examiner* — George Bugg
*Assistant Examiner* — Naomi Small
(74) *Attorney, Agent, or Firm* — Husch Blackwell LLP

(57) ABSTRACT

A video distribution system can present pictorial information relative to a developing alarm condition. Pre-recorded, or live images can be presented automatically in response to alarm indicating indicia, or, minimal inputs.

19 Claims, 4 Drawing Sheets

SYSTEMS AND METHODS OF INFORMATION DISTRIBUTION

FIELD

The invention pertains to audible and visible alarm related information systems. More particularly, the invention pertains to systems and methods of providing information to a plurality of displaced locations in a region relative to potential or actual alarm conditions.

BACKGROUND

Various traditional means for alerting people of emergency events are based on the use of audible and visual type devices. These devices are typically dedicated for emergency annunciation and give general information about the event.

Known types of horns and strobes do not give precise event information. They also do not inform individuals in the area of the appropriate response. Audio systems give more information but some facilities do not have voice evacuation systems.

Many buildings have a video transmission system infrastructure. One example is hotels. In most contemporary hotels, all rooms have televisions. However hotels do not necessarily have voice evacuation systems.

There are thus continuing needs to provide more complete information to individuals as to developing emergency situations than is often now the case. Systems and methods that integrate existing monitoring or emergency systems with the audio and video infrastructure typically found in modern buildings have the potential of delivering more precise, detailed and easy to understand situational information to people in such buildings as well as emergency personnel responding to the event.

DETAILED DESCRIPTION

Figure 1:
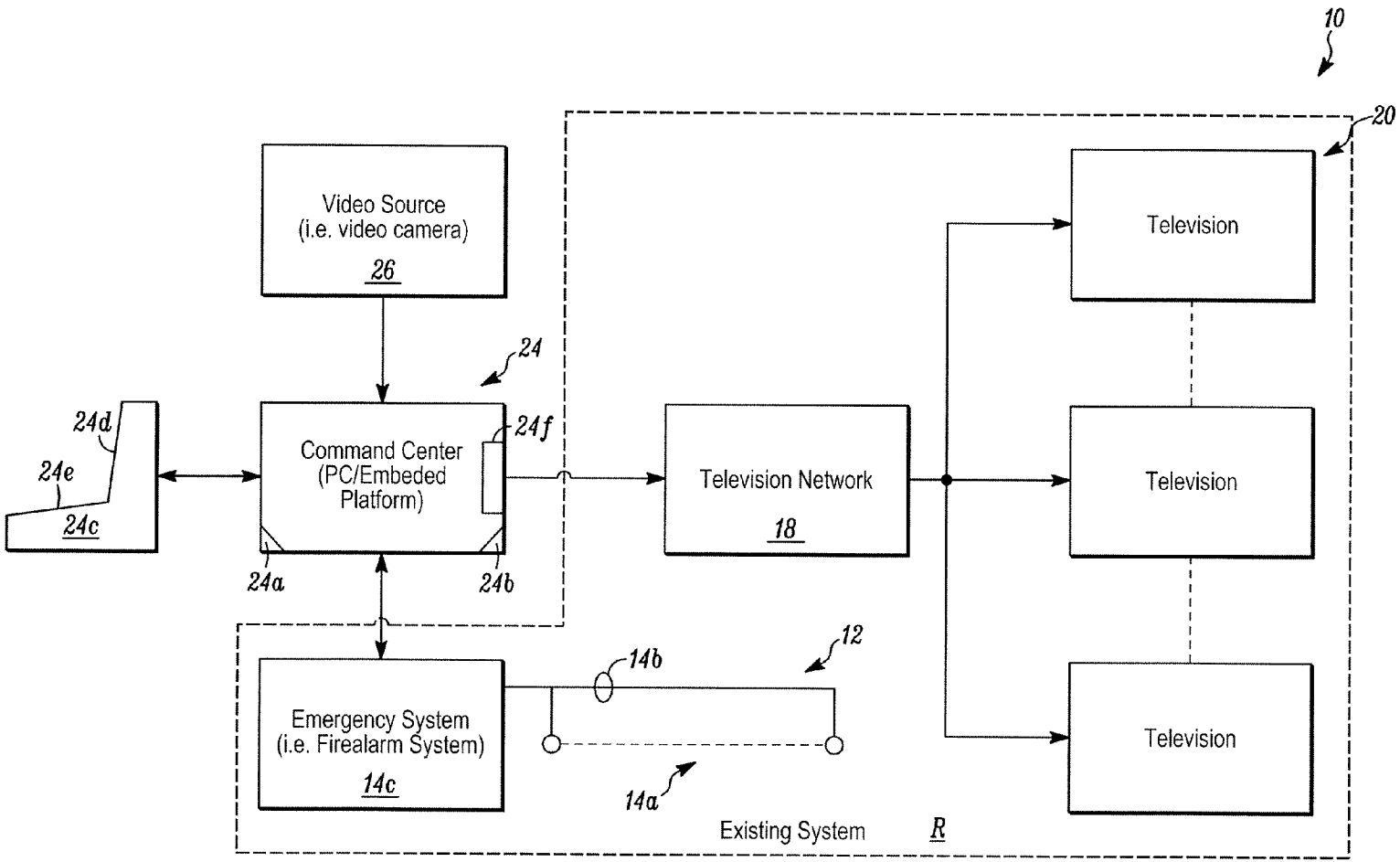
FIG. 1 is overall block diagram of a system which embodies the present invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of the invention are useful at/in airports, hotels or schools. These places typically have an installed central video transmission system (VTS) that is used for entertainment and general information. An emergency control system could be integrated into the centralized video and/or audio systems in order to immediately inform and alert occupants of a current situation and an appropriate response. The information sent to the VTS could be in the form of audio, video, text or any combination of the three. Additionally, the control system can send commands to the VTS that could control (on/off, volume,) individual video terminals. Different information can be sent to different video terminals depending on the emergency situation and its location.

An emergency control system in accordance with the invention could include any one a fire alarm panel, fire alarm network, fire alarm workstation, security, card access systems or CCTV. Other systems that can be integrated include building automation systems or any monitored system within a facility.

FIG. 1 illustrates a system 10 in accordance with the invention. The system 10 includes a regional monitoring system, 12, such as an ambient condition monitoring system, which responds to developing fire or gas conditions for example, or a security system as well as an HVAC system. In the instance where the system 12 is implemented as a fire alarm system it could include a plurality of ambient condition detectors 14*a*. The detectors 14*a* could include fire detectors, smoke detectors, gas detectors and the like all without limitation. Where the system 12 corresponded to a security system the detectors could include motion sensors, position sensors and the like.

The detectors 14*a* are coupled via a medium 14*b*, which could be wired or wireless, to a common control panel 14*c*.

It would be understood by those of skill in the art that the control panel or control unit of 14*c* could be implemented with the one or more programmable processors and associated control software which when executed would access signals from one or more of the detectors 14*a* indicative of developing conditions such as fire, smoke or gas.

System 10 could also include a television or video distribution network 18 which is in turn coupled to a plurality of output units 20. The output units 20 could correspond to multi-dimensional display units of one technology or another, monitors, television sets or the like all without limitation. The distribution system or network 18 provides video-type signals to the members of the plurality 20 for presentation thereat. The exact form of such signals is not a limitation of the invention. Signal types other than video come within the spirit and scope of the invention.

The systems 12 and 18, 20 could correspond to previously installed monitoring and video distribution systems associated with a region R. For example, systems 12 and 18, 20 could be installed in hotel/motel complexes, airports, school buildings or the like.

System 10 also includes a command center 24 which could be implemented by one or more programmable processors 24*a* and executable control software 24*b*. Command center 24 can also incorporate an operator communications device 24*c* which includes a multi-dimensional display unit 24*d* to present information visually to an operator, via graphical user interface software, 24*b* and one or more manual input devices 24*e*. The devices 24*e* can include keyboard, mouse or the like all without limitation.

A source of video signals 26, such as a video camera, can be coupled to command center 24 and video encoder 24*f* to provide operator initiated real time video signals for transmission to the display units or televisions 20. The source 26 can be used to enable an operator to deliver live video instructions to the display devices 20.

The command center 24 can monitor developing emergency events as indicated by the system 12. Once activated, command center 24 can couple either pre-recorded or live video feed, from video source 26, via network 18 to the plurality of displays 20.

The network 18 and display units 20 can in normal circumstances present entertainment programs or video signals to the display units 20 to provide information to individuals in the vicinity of the respective units. During developing emergency conditions, the command center 24 can couple either pre-recorded or live video signals, from an operator O, via video encoder circuitry 24*f* to network 18 for distribution to the various display units 20. Commands or information sent from the center 24 to the distribution network could be in the form of audio, video, text or any other combination thereof.

Command center 24 can also forward commands to distribution network 18 which would provide on off/volume type controls to the various individual display units or terminals 20. The command center 24 could also send different signals to different members of the plurality 20 depending on the developing emergency situation and its location.

Where the region R corresponds to a hotel/motel complex, in the event of a developing fire or gas-type condition being monitored and tracked by the system 12, audio and visual information could sent to the occupants of the various rooms therein via command center 24, distribution network 18 to respective television unit or display devices, a member of the plurality 20, in the various rooms. Such information could inform the respective occupant or individual as to the location of a developing fire or alarm condition, details about the type of fire and its characteristics, what action that individual should take at that time as well as preferred evacuation routes, if any.

In connection with the same type of hotel/motel complex where the developing condition corresponded to a weather problem, an intrusion or similar type of problem the system operator, via the command center 25 and the distribution network 18 can send event related information to the various television or display units of the plurality 20. For example, evacuation information could be provided in the event of a weather or intrusion event.

Figure 2:
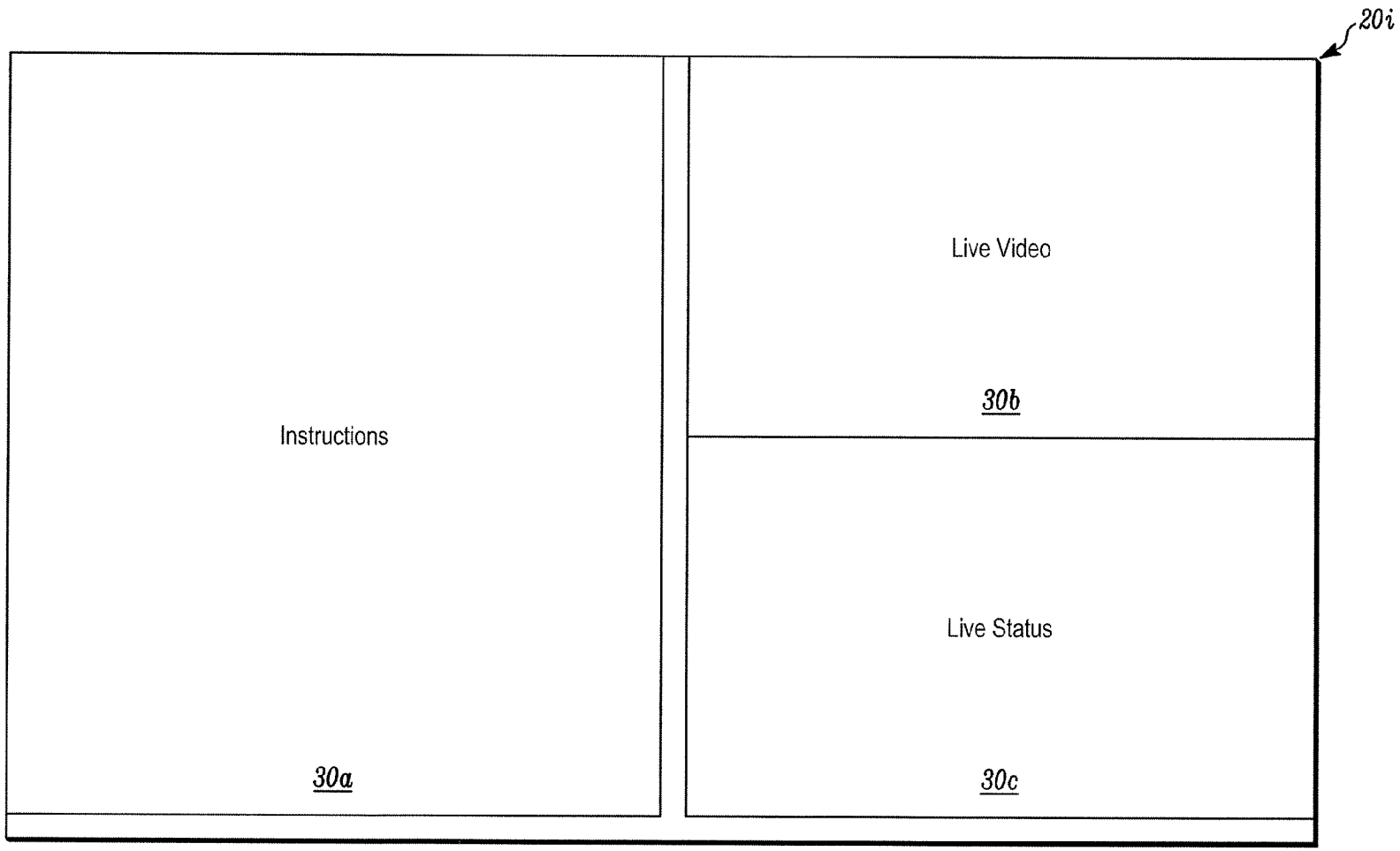
FIG. 2 illustrates an exemplary multi-segment display in accordance with the present invention.

FIG. 2 illustrates a sample display which might be presented on a monitor or television unit 20*i* of the plurality 20. Information can be presented in a plurality of separate regions on the display device including instructions 30*a*, live video 30*b* from first responders such as firefighters or the like, which could generated at video source 26 as well as live text-type status information 30*c*. Those of skill in the art will understand that other combinations and divisions of the context of such displays come within the spirit and scope of the present invention.

Figure 3:
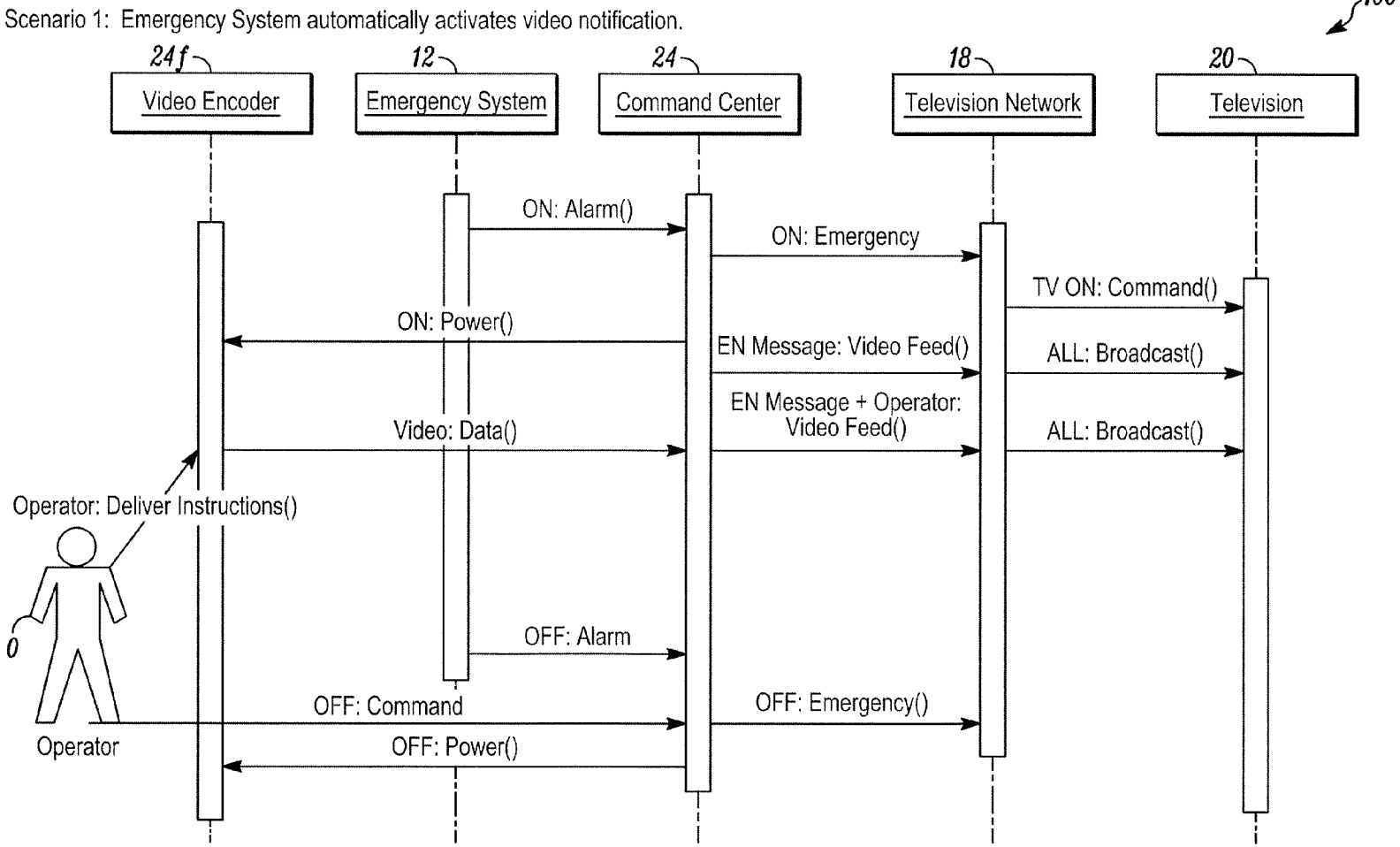
FIG. 3 is illustrates a first activation sequence in accordance with the invention.
Figure 4:
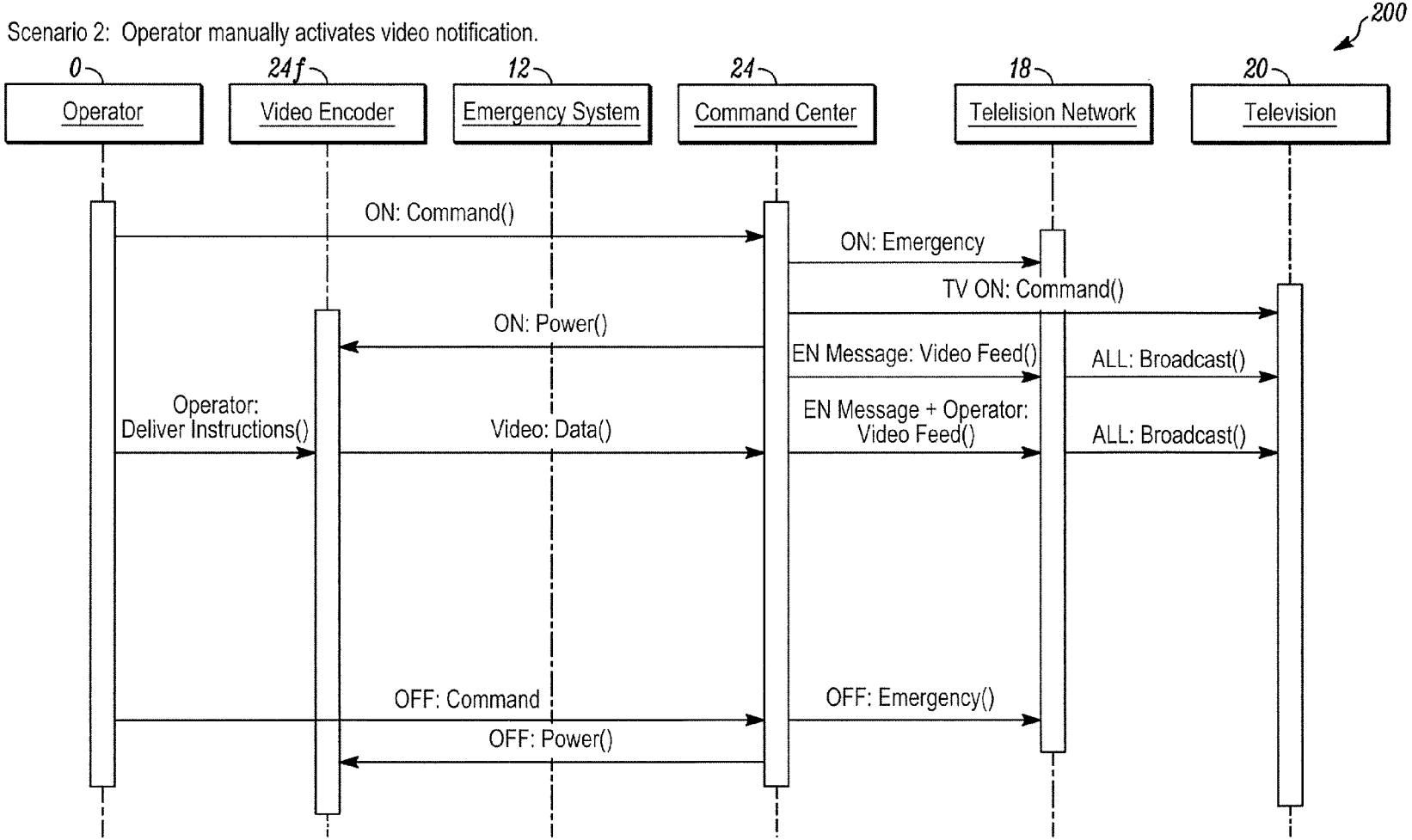
FIG. 4 illustrates an alternate activation sequence in accordance with the invention.

FIGS. 3 and 4 illustrate sequences or methods 100, 200 in accordance with the invention. In the sequence 100, the monitoring or emergency system 12 couples an alarm or condition indicating signal to command center 24. The center 24 initiates emergency broadcasting via network 18 to the plurality of display or television-type units 20.

The network 18 interrupts normal broadcasting which may be taking place and begins broadcasting either pre-stored or live emergency information from the command center 24. As part of this problem it can send a "turn on" command to members of the plurality 20. Substantially simultaneously, the command center 24 will attempt to activate the video encoder 24*f* and to couple signals carrying either pre-recorded or live data, via network 18 to the members of a plurality 20. The live signals can originate at video source 26 and the operator can provide real time status information, instructions and the like, with or without pre-recorded information, via the network 18 to the members of the plurality 20.

When the alarm condition has abated or been terminated, the operator O can issue one or more terminate or "OFF" commands via the command center 24 and network 18 to the members of the plurality 20. Alternately, the emergency system 12 can automatically issue such commands via the command center 24.

Alternately, as illustrated in sequence 200 of FIG. 4, the operator O can initiate the emergency notification process with a turn-on or "On" command to the command center 24 as well as enter instructions via input device 25*e* or via video source 26 to the video encoder 24*f*. Network 18 can be activated and an in turn issue a "On" command to the members of the plurality 20 followed by live or pre-stored messages or information. When the event or condition has been resolved or terminated the operator O can issue a "OFF" command to the command center 24 which in turn can terminate the process.

Those of skill in the art will understand that neither the characteristics of the signals forwarded by network 18 nor the detailed characteristics of the display units of the plurality 20 are limitations of the present invention. Further, the form of the pre-recorded information, which might be implemented as pre-stored binary information, is not a limitation of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A method comprising:

a previously installed central television distribution network broadcasting entertainment programs to a plurality of multi-dimensional display units located in different areas within a building;

an existing ambient condition monitoring system including a command center within the building monitoring environmental conditions within the building;

providing a source of video signals coupled to and proximate the command center that enables an operator of the command center to generate and distribute operator initiated real time video signals to the plurality of multi-dimensional display units;

coupling a video encoder between the source of video signals of the command center and the television distribution network;

at least one ambient condition detector of the ambient condition monitoring system sensing a potential alarm condition in an identified region of the building, the at least one ambient condition detector coupled to the command center;

the command center coupling location-specific multi-dimensional visual information relative to the condition through the video encoder to the plurality of multi-dimensional display units located in immediately and potentially affected regions of the building via the television distribution network; and the television network interrupting the entertainment programs if the specified multi-dimensional display unit is powered on, if the multi-dimensional display unit is powered off, sending a power on command from the command center coupled with the video signals, if the multi-dimensional display unit is muted, sending a volume control command from the command center coupled with the video signals, and broadcasting the location specific visual information including the real time video signals to respective ones of the plurality of multi-dimensional display units located throughout the immediately and potentially affected regions of the building, to immediately inform and alert occupants of a current situation and an appropriate response.

2. A method as in claim 1 where distributing includes distributing video-type signals to the display units.

3. A method as in claim 1 which includes providing live video-type information for distribution.

4. A method as in claim 1 where sensing includes sensing ambient conditions at a plurality of locations throughout the region.

5. A method as in claim 4 where indicia relative to the ambient conditions are presented at least in part visually at a predetermined location.

6. A method as in claim 5 where distributing the information includes distributing it from the predetermined location.

7. A method as in claim 6 where distributing includes transmitting at least one of real-time video, or pre-recorded video to the display units.

8. A method as in claim 2 where distributing includes formatting the video-type signals to present multi-sectional, multi-dimensional images at the display units.

9. A method as in claim 8 where formatting includes providing at least some of instructions to recipients of the images, live video of a selected portion of the region, or, status information.

10. An apparatus comprising:

a previously installed central television distribution network that broadcasts visual images of entertainment programs, the distribution network is located in a building and coupled to a plurality of output units located in different areas within the building;

an existing ambient condition monitoring system in the building;

a control unit of the ambient condition monitoring system;

a source of video signals coupled to and proximate the control unit that enables an operator of the control unit to generate and to distribute operator initiated real time video signals to the plurality of output units;

a video encoder connected between the previously installed central network and the source of video signals of the system, the control unit, responsive at least in part to inputs from the system, couples signals, including power "ON" commands and volume control commands, via the previously installed central television distribution network to at least some of the plurality of multi-dimensional display units through the video encoder that interrupts the broadcast visual images of entertainment programs and directs location-specific visual images including the real time video signals from the source of video signals of the control unit to respective ones of the plurality of output units located in immediately and potentially affected regions of the building, to immediately inform and alert occupants of a current situation and an appropriate response.

11. An apparatus as in claim 10 which includes pre-stored images coupled to the control unit.

12. An apparatus as in claim 10 which includes a video camera, coupled to the control unit, the camera provides live video signals.

13. An apparatus as in claim 12 which includes pre-stored video coupled to the control unit.

14. An apparatus as in claim 13 which includes circuitry to format selected video signals into a multi-sectional visual display prior to distribution via the network.

15. An apparatus as in claim 14 where the circuitry generates signals to present real-time images on one section of the display.

16. An apparatus as in claim 10 where the control unit includes circuitry, responsive to alarm indicating indicia from the monitoring system, that terminates existing image transmission, and, initiates transmission of alarm related signals.

17. An apparatus as in claim 16 where the control circuitry also responds to manually initiated inputs.

18. An apparatus as in claim 15 wherein the output units comprise which graphical display devices.

19. An apparatus as in claim 18 where the monitoring system includes at least some of fire detectors, smoke detectors, gas detectors, thermal detectors, or, motion detectors.

* * * * *